US005685225A

United States Patent [19]

Gensheimer et al.

[11] Patent Number: 5,685,225

[45] Date of Patent: Nov. 11, 1997

[54] APPARATUS AND METHOD FOR REGULATING INK DISTRIBUTION IN A PRINTING MACHINE

[75] Inventors: Valentin Gensheimer, Muhlheim; Achim Stoffler; Peter Hummel, both of Offenbach; Robert Ortner, Alzenau, all of Germany

[73] Assignee: MAN Roland Druckmaschinen AG, Germany

[21] Appl. No.: 514,151

[22] Filed: Aug. 11, 1995

[30] Foreign Application Priority Data

Aug. 11, 1994 [DE] Germany ..... 44 28 403.9

[51] Int. Cl.[6] ..... B41F 31/06; B41F 31/14

[52] U.S. Cl. ..... 101/350; 101/485; 101/DIG. 32

[58] Field of Search ..... 101/350, 349, 101/351, 352, DIG. 32, 148, 207–210, 363, 484, 485, 340, 344, 347, 356, 360, 361, 483

[56] References Cited

U.S. PATENT DOCUMENTS 3,013,489 12/1961 Moser et al. .
5,493,970 2/1996 Stoffler et al. ..... 101/363

FOREIGN PATENT DOCUMENTS 0 475 120 A1 8/1991 European Pat. Off. .
212 475 B1 3/1989 Germany .
271 086 A1 8/1989 Germany .
276 455 A1 2/1990 Germany .
2193926 2/1988 United Kingdom ..... 101/DIG. 32

*Primary Examiner*—J. Reed Fisher
*Attorney, Agent, or Firm*—Leydig, Voit & Mayer, Ltd.

[57] ABSTRACT

An undershot inking unit for a printing machine and a method for regulating ink distribution in a printing machine are disclosed. The undershot inking unit comprises an ink fountain roller communicating with an ink fountain, an inking roller, and an intermittent ductor roller for transferring ink from the ink fountain roller to the inking roller. In accordance with the present invention, the ductor roller is thrown onto the ink fountain roller at a rate that is independent of the printing speed of the printing machine, preferably, at a rate that is constant for all printing speeds. The disclosed apparatus and method alleviate the problem of ink fall-off in printing machines.

17 Claims, 3 Drawing Sheets

APPARATUS AND METHOD FOR REGULATING INK DISTRIBUTION IN A PRINTING MACHINE

TECHNICAL FIELD OF THE INVENTION

The present invention relates generally to a method and apparatus for regulating the distribution of ink in a printing machine. More specifically, the present invention is directed towards an undershot inking unit and an associated method for regulating the ink distribution in a variable speed printing machine.

BACKGROUND OF THE INVENTION

In sheet-fed offset printing machines, the supply of printing ink is generally accomplished by means of an undershot inking unit. Undershot inking units comprise an ink fountain and associated metering devices, such as ink-metering elements or undivided ink doctor blades; an ink fountain roller; an intermittent ductor roller, and one or more inking rollers. By means of the metering elements, the ink layer thickness on the ink fountain roller is adjusted in accordance with the requirements of the printing machine.

The intermittent ductor roller, as a result of periodic contact with the ink fountain roller, removes a strip of ink of a certain length from the ink fountain roller and transfers the ink onto a first inking roller. This first inking roller is usually designed as an axially reciprocating distributor roller for contacting further inking rollers through traversing movements of adjustable stroke and/or frequency. By means of these further inking rollers, the ink quantity fed by the ductor roller splits and correspondingly leads to an inking of the printing regions on the printing form or plate located on the plate cylinder.

Numerous undershot inking units including such an arrangement of rollers are known in the art. For example, in DE 276,455 A1, DE 212 475 B1, GB 2,192,926, and U.S. Pat. No. 3,013,489, undershot inking units including intermittent ductor rollers are disclosed. In DE 276,455 A1, the ductor roller is driven by means of a cam mechanism. The cam is driven by an adjustable variable-speed electric motor, and the rotational speed of the cam is controlled according to the speed of the printing unit of the printing machine. In DE 212 475 B1, the ductor roller similarly is driven via a cam mechanism. The cycle of the ductor roller is interrupted with an interlock lever, thus adjusting the cycle of the ductor roller to thereby regulate the feed of ink to the inking roller. GB 2,192,926 discloses a ductor roller that is electronically controlled. U.S. Pat. No. 3,013,489 discloses an undershot inking unit including an intermittent ductor roller that is swivelled by means of operating cylinders which are acted upon by a pressure medium supplied by a conveying pump. Pressure is regulated by a distributor driven in synchronization with the printing speed of the machine.

The distribution of ink in such printing machines is typically determined during setup of the printing machine. This generally occurs at a relatively low printing speed, such as 5,000 sheets per hour with a conventional offset printing machine. During actual production, however, the production speeds of such machines can be greater than 15,000 sheets per hour. When the undershot inking unit has been calibrated at a lower printing speed, it is invariably observed that the ink densities detected on a print check strip and in the image decrease as a whole. The ink density changes from low to high production speed are typically quite significant in the prior art machines. This effect is know as ink fall-off or fade-out. Conversely, if the undershot inking unit has been calibrated at a relatively high printing speed, the ink densities will increase as the printing speed is lowered. This effect is known as increased inking.

One cause of the ink fade-out problem is that the ink fountain roller and ductor roller typically rotate at different circumferential speeds. Thus, when the ductor roller first contacts the ink fountain roller, the ductor roller briefly "floats" before an ink strip is transferred. When the oscillation of the ductor roller is controlled according to the printing speed of the printing machine, the period of contact of the ductor roller with the ink fountain roller becomes decreasingly smaller as the printing speed is increased. The ink transfer to the ductor roller thus deteriorates as the printing speed is increased. A similar "float" effect occurs as the ductor roller is thrown onto the inking roller.

The prior art undershot inking units described above have failed to provide a satisfactory solution to the problem of ink fade-out. For example, in U.S. Pat. No. 3,013,489, because the distributor is driven in synchronization with the printing speed, the ductor roller will move to contact the ink fountain roller at a rate that is dependent upon the printing speed. The problem of ductor roller "float" thus is not resolved. GB 2,192,926 is silent as to the problem of ductor "float," and it is unclear from this reference as to how the ductor roller moves to contact the ink fountain roller.

In addition to the previously described units, undershot inking units are known in which the circumferential speed of the ductor roller is synchronized with that of the ink fountain roller. These units, however, are very complex, and still do not solve the problem of ink fade-out.

Accordingly, it is a general object of the present invention to provide an undershot inking unit for a printing machine that resolves the problem of ink fade-out. It is a further general object of the present invention to provide a method for regulating ink distribution in a printing machine, in which method the problem of ink fade-out is alleviated.

BRIEF SUMMARY OF THE INVENTION

The present invention provides an undershot inking unit for a printing machine and a method for regulating ink distribution in a printing machine. The undershot inking unit comprises an ink fountain roller communicating with an ink fountain, an inking roller, and an intermittent ductor roller for transferring ink from the ink fountain roller to the inking roller. In accordance with the present invention, the ductor roller is thrown onto the ink fountain roller at a rate that is independent of the printing speed of the printing machine, preferably, at a rate that is constant for all printing speeds. The ductor roller also is preferably thrown off of the ink fountain roller at a rate that is independent of the printing speed. If the ductor roller is thus thrown onto and off of the ink fountain roller independent of the printing speed, no changes in the ink transfer that are dependent upon the printing speed will occur. The present invention thus alleviates the problem of ink fall-off in a manner heretofore unknown to the art.

DESCRIPTION OF THE PREFERRED EMBODIMENTS

The present invention utilizes the knowledge that inks used in offset printing technology have pronounced non-Newtonian properties. Because the ink fountain roller is driven at a speed independent from the printing speed, and because the ductor roller is thrown onto the ink fountain roller at a rate independent of the printing speed of the printing machine, the ink will not transfer from the ink fountain roller to the inking roller as a function of the printing speed.

Figure 1:
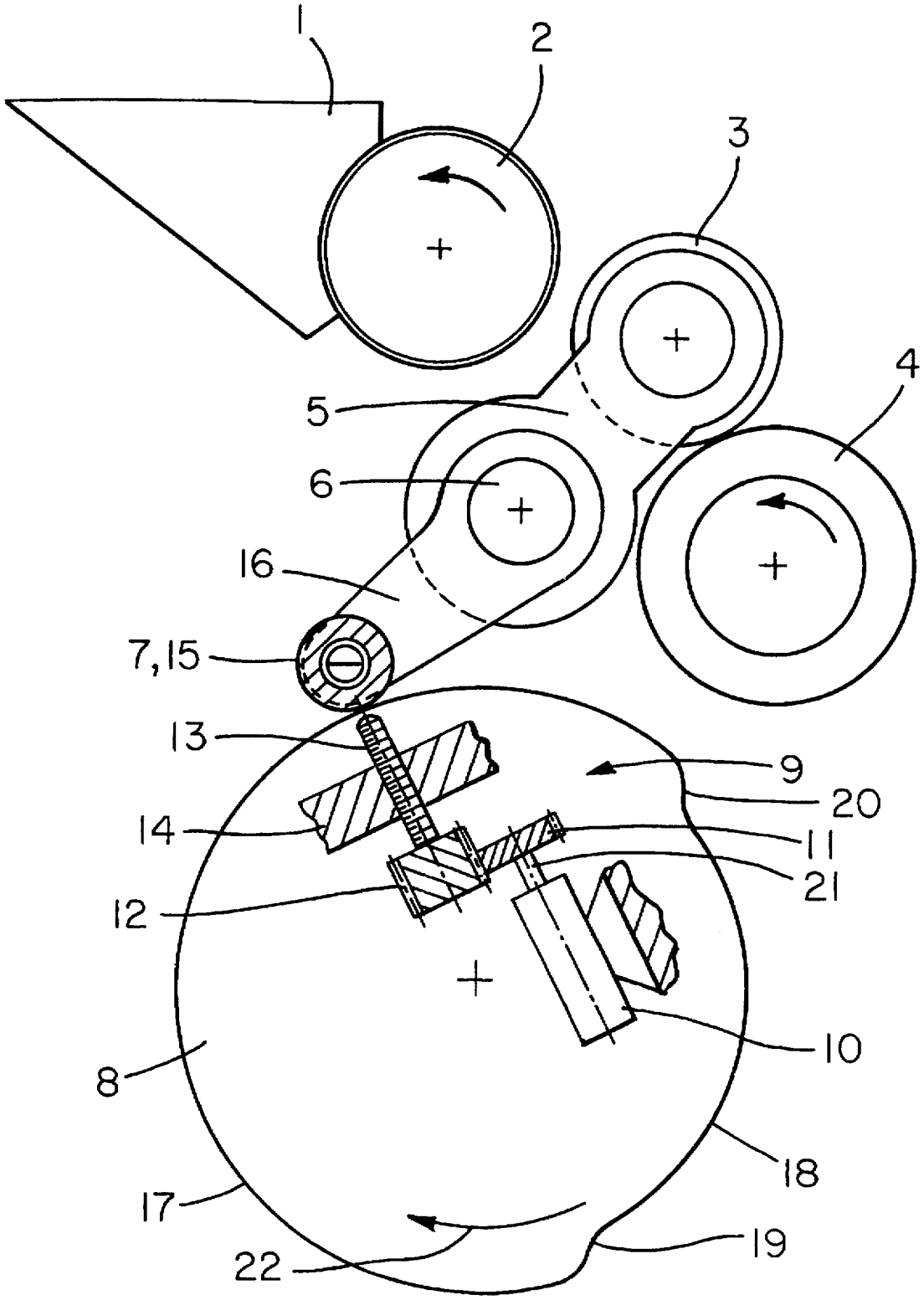
FIG. 1 is a side view of an undershot inking unit for a printing machine according to the present invention, including a cam follower roller connected to a pivotal lever arm journalling a ductor roller, the cam follower roller driven by a control cam, and further including a lifter for selectively preventing and allowing the cam follower roller from engaging and traversing selected portions of the control cam.

With reference to FIG. 1, an ink fountain 1 cooperates with an ink fountain roller 2 and conventional ink metering elements (not shown) mounted on the underside of the ink fountain 1. Preferably, the ink fountain roller 2 is directly coupled with a motor driven by an electronic drive with the interposition of a suitable reduction gear (not shown). The ink fountain roller 2 preferably is driven at a constant value independent of the printing speed. Thus, the electronic drive of the ink fountain roller is not coupled to the control of the remaining printing machine.

The undershot inking unit includes an intermittent ductor roller 3 for receiving a strip of ink from the ink fountain roller 2 and transferring this strip of ink to an inking roller 4. This inking roller 4 preferably is a distributor roller which oscillates axially to deliver ink to further downstream inking rollers. In order to convey correspondingly more ink onto the inking roller per unit of time at higher printing speeds, the rotational contact angle of the ductor roller on the ink fountain roller is increased with an increasing printing speed.

The ductor roller 3 is journalled between a pair of pivotally mounted levers 5, which are joined at a shaft 6 (shown in cross section in FIG. 1) to thereby form a pivotal lever arm. Shaft 6 extends over the width of the ductor roller 3 and is fixed to the frame of the printing machine so as to form a pivotal support for the ductor roller 3. One end of a pivotal support lever 5 includes an extension arm 16 on which is a rotatably mounted cam follower roller 7. The cam follower roller 7 is biased against a control cam 8 by means of a spring (not shown). The camming of the cam follower roller 7 running along the contour of the control 8 cam generates the intermittent pendulating movement of the ductor roller 3 between the ink fountain roller 2 and the inking roller 4.

The control cam 8 includes a predominant circumferential contour 17 and a subordinate circumferential contour 18. As illustrated in FIG. 1, the predominant circumferential contour is allocated to the throw of the ductor roller 3 on the inking roller 4, whereas the subordinate circumferential contour 18 is allocated to the throw of the ductor roller 3 on the inking roller 4. The subordinate circumferential contour is bounded by first and second boundary regions 19, 20; in these positions, the ductor roller is thrown neither on the ink fountain roller nor on the inking roller. Preferably, the control cam 8 is driven at a speed dependent upon the printing speed; most preferably, at a 1:3 ratio to the printing speed. That is, the control cam turns once when the printing machine makes three single-turn rotations.

The undershot inking unit includes a lifter 9 for selectively preventing and allowing the cam follower roller 7 to engage and traverse the control cam 8 at the subordinate circumferential contour 18. Lifter 9 comprises a reversible adjusting motor 10 fastened to the frame of the printing machine (illustrated behind the control cam 8 in FIG. 1). The reversible adjusting motor 10 rotates a rotor shaft 21 in either direction of rotation at a constant speed. Mounted on the rotor shaft 19 is a first pinion 11, which is designed as a straight-toothed cylindrical gear. This first pinion 11 meshes with a second pinion 12 mounted to the end of a threaded spindle 13. Spindle 13 is threaded into a threaded nut 14 fixed to the frame of the printing machine. The second pinion 12 reciprocates axially, but always remains with its entire width engaged in intermeshing relationship with the first pinion 11. Thus, rotation of the adjusting motor 10 is converted to axial translation of the threaded spindle 13.

The adjusting motor 10 is regulated by a control (not shown), which delivers pulses to actuate the adjusting drive 10 at the requisite points in time. The control can be operatively connected to sensors that scan markings on the control cam 8 to thereby sense that the control cam 8 has rotated to a position such that actuation of the adjusting motor 10 is required. Alternatively, or in addition thereto, the sensors may sense that the control cam has reached the first and second boundary regions 19, 20. By means of the control, it may further be possible to trigger the adjusting motor 10 at points in the cycle of the control cam dependent upon the printing speed. By so doing, the rotational contact angle of the ductor roller on the ink fountain roller may be adjusted in dependence on the printing speed; this may also be done to effect an idle-time compensation.

Figure 2:
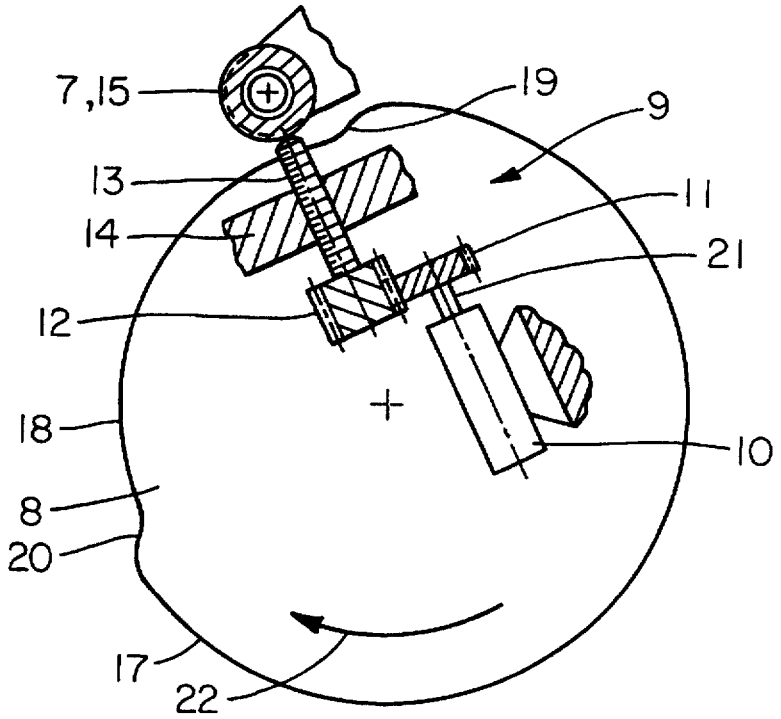
FIG. 2 is a side view of the undershot inking unit illustrated in FIG. 1, showing the lifter in a position preventing the cam follower roller from engaging and traversing a portion of the control cam.
Figure 3:
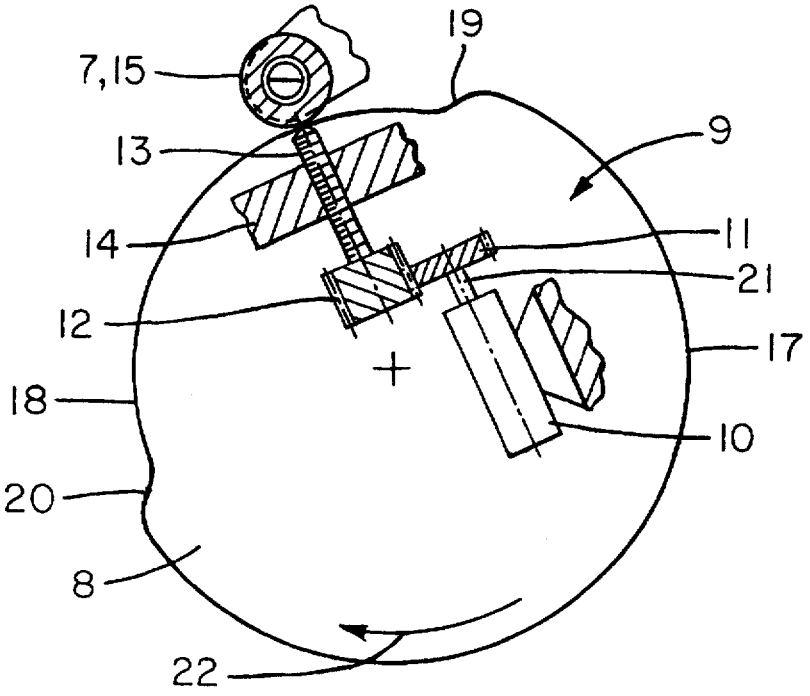
FIG. 3 is a side view of the undershot inking unit illustrated in FIG. 1, showing the lifter in a position allowing the cam follower roller to engage and traverse the control cam.
Figure 5:
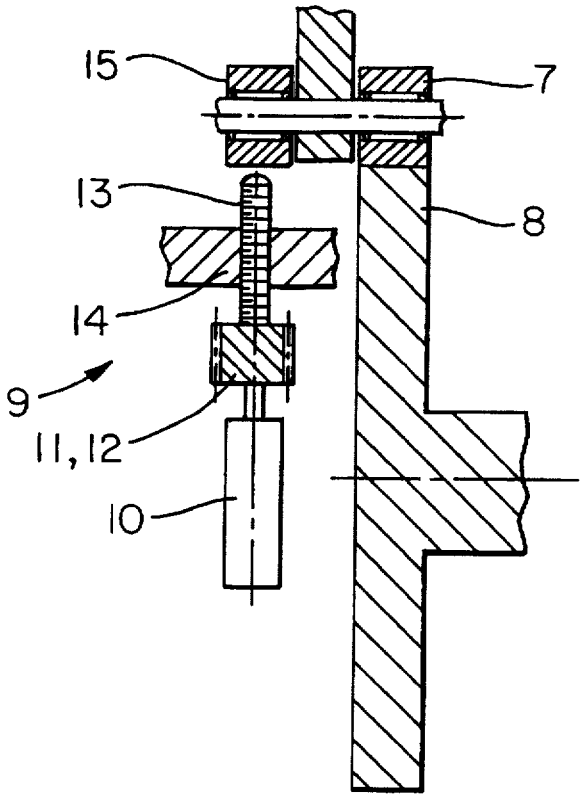
FIG. 5 is a front view of the undershot inking unit illustrated in FIG. 1, showing the lifter in a position allowing the cam follower roller to engage and traverse the control cam.
Figure 4:
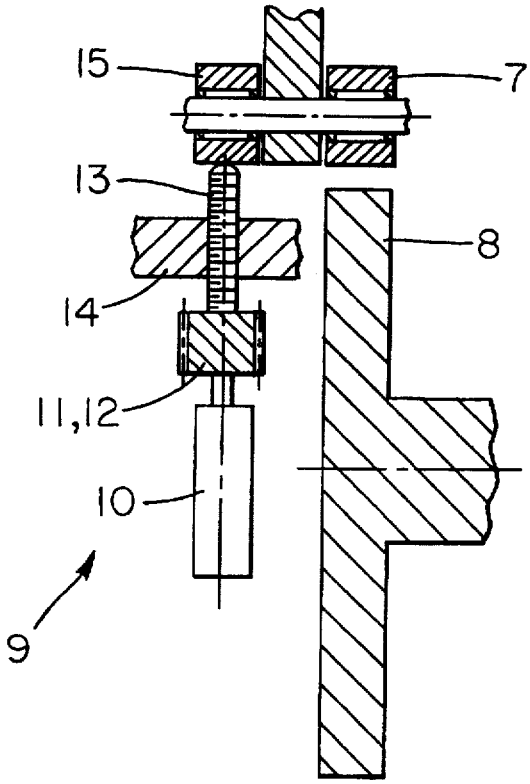
FIG. 4 is a front view of the undershot inking unit illustrated in FIG. 1, showing the lifter in a position preventing the cam follower roller from engaging and traversing a portion of the control cam.

FIGS. 2–5 illustrate the operation of the lifter 9 on the ductor roller 3. As illustrated in FIGS. 4 and 5, a lifter roller 15 is mounted on the extension arm 16, and is axially aligned with the cam follower roller 7 but not engaging the control cam 8. The threaded spindle 13 engages the lifter roller 15 and urges the extension arm 16 away from the control cam 8.

Rotation of the control cam, as illustrated successively in FIGS. 1 to 3, proceeds in the direction of arrow 22. When the control cam is in the position illustrated in FIG. 1, the ductor roller 3 is thrown onto the inking roller 4. The control cam next rotates to the position illustrated in FIG. 2. When in this position, the threaded spindle 13 is extended to engage the lifter roller 15, thus preventing the cam follower roller 7 from engaging and traversing the control cam at the subordinate circumferential contour 18. Accordingly, the cam follower roller 7 is not allowed to engage and traverse the control cam 8 at the first boundary region 19. The ductor roller (not shown in FIGS. 2–5) is thus held in a position where it does not contact the ink fountain roller; i.e., a position between the ink fountain roller and the inking roller.

Next, the threaded spindle 13 is retracted by means of the reversible adjusting motor 10. This retraction occurs at a rate that is independent of the printing speed; preferably, the rate of retraction is constant for all printing speeds. When the threaded spindle 13 is retracted fully, the cam follower roller 7 is allowed to engage and traverse the control cam 8. The ductor roller is therefore moved at a rate independent of the printing speed from a position where it does not contact the ink fountain roller to a position where it contacts the ink fountain roller. This effect also is illustrated in FIGS. 4 and 5. FIG. 4 illustrates the extended threaded spindle, and FIG. 5 illustrates the retracted threaded spindle.

Preferably, a complementary process occurs before the control cam has 8 rotated to a position where it is engaged and traversed by the cam follower roller 7 at the second boundary region 20. The threaded spindle 13 is extended to thereby hold the ductor roller in a position where it contacts neither the ink fountain roller nor the inking roller. The spindle is extended at a speed that is independent of the printing speed; preferably, at a constant speed for all printing speeds. When the control cam 8 has rotated further, the cam follower roller 7 will be allowed to ascend the control cam 8 at the second boundary region 20, thus once again engaging and traversing the control cam 8. Accordingly, the ductor roller is moved at a rate independent of the printing speed of the printing machine from a position where it contacts the ink fountain roller to a position where it does not contact the ink fountain roller.

By so alternately extending and retracting the threaded spindle 13, the ductor roller is thrown onto and off of the ink fountain roller at a rate that is independent of the printing speed of the printing machine. When this rate is held constant for all printing speeds, the ductor roller takes the same amount of time to lower itself onto and raise itself off of the ink fountain roller, regardless of the printing speed. Thus, the problem of ink fall-off is alleviated.

In a preferred embodiment of the present invention, the ductor roller also is thrown onto and off of the inking roller at a rate that is independent of the printing speed. The method of the present invention thus includes the step of moving the ductor roller at a rate independent of the printing speed of said printing machine from a position where the ductor roller does not contact said inking roller to a position where the ductor roller does contact the inking roller. Preferably, the ductor roller is subsequently moved independently of the printing speed of the printing machine from a position where it contacts the inking roller to a position where it does not contact the inking roller.

In an alternative embodiment of the present invention, the undershot inking unit does not include a lifter. Rather, the control cam is driven by an electric motor controllable independently of the printing speed of the printing machine. The motor is controlled such that the control cam is driven at a rate independent of the printing speed when the cam follower roller traverses the first and second boundary regions of the control cam. At all other times, i.e., when the cam follower roller traverses the subordinate and predominant circumferential contours of the control cam, the control cam is driven at a rate dependent upon the machine speed. Thus, the ductor roller will be thrown onto and off of the ink fountain roller at a rate that is independent of the printing speed of the printing machine. As hereinbefore described, the control may be operatively linked to sensors that scan markings on the control cam, or that sense the rotation of the control cam through the boundary regions. The rotational speed of the control cam may be adjusted, if necessary, to keep the rotation of the control cam in phase with the cycle of the printing machine.

While particular embodiments of the invention have been shown, it will of course be understood that the invention is not limited thereto since modifications may be made by those skilled in the art, particularly in light of the foregoing teachings. Thus, for example, the present invention encompasses a printing machine including an undershot inking unit as hereinbefore described. It is, therefore, contemplated by the appended claims to cover any such modifications as incorporate those features which constitute the essential features of these improvements within the true spirit and scope of the invention. All references and previous applications cited herein are hereby incorporated by reference in their entireties.

What is claimed is:

1. An undershot inking unit for a printing machine, said undershot inking unit comprising:

an ink fountain for supplying printing ink;

an ink fountain roller communicating said ink fountain;

inking roller;

a drive for rotating said ink fountain roller, whereby an ink film is generated on the surface of said ink fountain roller, an intermittent ductor roller journalled on a pivotal support for periodically engaging said ink fountain roller and said inking roller to transfer said ink film from said ink fountain roller to said inking roller; and a ductor roller drive for pivoting said support and causing said ductor roller to intermittently engage said ink fountain roller and said inking roller;

said ductor roller drive including a rotatable control cam, said control cam having a predominate circumferential contour allocated to the throw of said ductor roller onto said inking roller and subordinate circumferential contour allocated to the throw of said ductor roller on said ink fountain roller;

said pivotal support having a cam follower for cooperative engagement with said control cam to thereby cause the ductor roller to intermittently engage the ink fountain roller and the inking roller in response to rotation of control cam; and a lifter operable independent of the printing speed of said printing machine for selectively preventing said cam follower to engage said control cam at said subordinate circumferential contour so that said pivot support and the ductor roller supported thereby are periodically moveable at a rate independent of the printing speed of the printing machine.

2. An undershot inking unit of claim 1 in which said lifter is a spindle mounted for radial movement with respect to said control cam.

3. An undershot inking unit of claim 2 in which said lifter is a rotary spindle.

4. An undershot inking unit according to claim 1 in which said lifter is a spindle, and including a gear drive is operable for selectively advancing and retracting said spindle.

5. An undershot inking unit according to claim 4 in which said lifter comprises a threaded spindle, and a reversible drive connected to the spindle for alternately advancing and retracting said spindle.

6. An undershot inking unit according to claim 3 in which said spindle is threadedly engaged in a support.

7. An undershot inking unit according to claim 6 including a motor for selectively effecting relative rotational movement between said spindle and support.

8. An undershot inking unit according to claim 7 including a reversible drive motor for rotatably advancing and retracting the spindle relative to the support independent of the speed of the printing machine.

9. An undershot inking unit for a printing machine, said undershot inking unit comprising:

an ink fountain for supplying printing ink;

an ink fountain roller communicating with said ink fountain;

an inking roller;

a drive for rotating said ink fountain roller, whereby an ink film is generated on the surface of said ink fountain roller;

an intermittent ductor roller journalled on a pivotal support for periodically engaging said ink fountain roller and an inking roller to transfer said ink film from said ink fountain roller to said inking roller; and a ductor roller drive for pivoting said support and causing said ductor roller to intermittently engage said ink fountain roller and said inking roller;

said ductor roller drive including a rotatable control cam, said control cam having a predominant circumferential contour and a subordinate circumferential contour, said subordinate circumferential contour being bounded by a first boundary region and a second boundary region, said predominant circumferential contour being allocated to the throw of said ductor roller on said inking roller, said first boundary region being allocated to the transfer of said ductor roller from said inking roller to said ink fountain roller, said subordinate circumferential contour being allocated to the throw of said ductor roller on said ink fountain roller, said second boundary region being allocated to the transfer of said ductor roller from said ink fountain roller to said inking roller;

a cam follower connected to said pivotal support for engaging and traversing said control cam to thereby cause said intermittent ductor roller to periodically engage said ink fountain roller and said inking roller;

a lifter for selectively preventing said cam follower roller to engage and traverse said control cam at said subordinate circumferential contour;

means for lowering said lifter at a rate independent of the speed of said printing machine to thereby allow said cam follower roller to engage and traverse said subordinate circumferential contour; and means for raising said lifter at a rate independent of the speed of said printing machine to thereby prevent said cam follower roller from engaging and traversing said subordinate circumferential contour, whereby said ductor roller support moves at a rate independent of the rate of the printing speed of said printing machine in moving said ductor roller into and out of engagement with said fountain roller.

10. An inking unit according to claim 9, wherein said means for lowering said lifter include means for lowering said lifter at a constant speed for all printing speeds of said printing machine.

11. An inking unit according to claim 9, wherein said means for raising said lifter include means for raising said lifter at a constant speed for all printing speeds of said printing machine.

12. An inking unit according to claim 9, wherein said lifter comprises a threaded spindle, and said means for lowering and raising said lifter comprises a reversible drive operably connected to said threaded spindle for alternately extending and withdrawing said threaded spindle.

13. An inking unit according to claim 9, wherein said pivotal support includes a second roller coaxial with said cam follower roller for engaging said lifter.

14. A method for regulating the distribution of ink in an undershot inking unit for a printing machine, said undershot inking unit comprising an ink fountain; an ink fountain roller cooperating with said ink fountain, for generating an ink film on the surface of said ink fountain roller; an inking roller; and an intermittent ductor roller journalled on a pivotal support for transferring said ink film to said inking roller as a result of periodic engagement of said ductor roller with said ink fountain roller and said inking roller; said method comprising the steps of:

providing a rotatable control cam, said control cam having a predominant circumferential contour and a subordinate circumferential contour, said subordinate circumferential contour being bounded by a first boundary region and a second boundary region, said predominant circumferential contour being allocated to the throw of said ductor roller on said inking roller, said first boundary region being allocated to the transfer of said ductor roller from said inking roller to said ink fountain roller, said subordinate circumferential contour allocated to the throw of said ductor roller on said ink fountain roller, said second boundary region being allocated to the transfer of said ductor roller from said ink fountain roller to said inking roller;

providing a cam follower on said pivotal support for traversing said control cam to thereby cause said intermittent ductor roller to periodically engage said ink fountain roller and said inking roller;

providing a lifter for selectively preventing said cam follower from engaging and traversing said control cam over said subordinate circumferential contour;

during the rotational cycle of said control cam allocated to the throw of said ductor roller on said inking roller, raising said lifter to thereby prevent said cam follower roller from engaging and traversing said control cam over said subordinate circumferential contour;

during the rotational cycle of said control cam allocated to the throw of said ductor roller on said ink fountain roller, lowering said lifter at a rate independent of the speed of said printing machine to thereby allow said cam follower roller to engage and traverse said subordinate circumferential contour; and;

subsequently raising said lifter at a rate independent of the speed of said printing machine to thereby prevent said cam follower roller from engaging and traversing said subordinate circumferential contour, whereby said ductor roller pivotal support moves at a rate independent of the rate of the printing speed of said printing machine to engage and disengage said ductor roller with said ink fountain roller.

15. A method according to claim 14, wherein said control cam is rotated at a speed dependent upon the printing speed of said printing machine.

16. A method according to claim 14, wherein said steps of lowering said lifter and subsequently raising said lifter are performed at a constant rate for all printing speeds of said printing machine.

17. A method for regulating the distribution of ink in an undershot inking unit for a printing machine, said undershot inking unit comprising an ink fountain; an ink fountain roller cooperating with said ink fountain, for generating an ink film on the surface of said ink fountain roller; an inking roller; and an intermittent ductor roller journalled on a pivotal support for transferring said ink film to said inking roller as a result of periodic engagement of said ductor roller with said ink fountain roller and said inking roller; said method comprising the steps of:

providing a rotatable control cam, said control cam having a predominant circumferential contour allocated to the throw of said ductor roller on said inking roller and a subordinate circumferential contour allocated to the throw of said ductor roller on said ink fountain roller, providing a cam follower on said pivotal support for engaging and traversing said control cam to thereby cause said intermittent ductor roller to periodically engage said ink fountain roller and said inking roller;

providing a lifter for selectively preventing said cam follower from engaging and traversing said control cam over said subordinate circumferential contour;

raising and lowering said lifter relative to said cam follower roller and said pivotal support to control the timing of engagement and traversing of said cam follower with said subordinate circumferential contour so that said pivotal support and the ductor roller supported thereby are periodically moveable at a rate independent of the printing speed of the printing machine.

* * * * *